United States Patent [19]

Gehring

[11] Patent Number: 4,815,396

[45] Date of Patent: Mar. 28, 1989

[54] SUSPENDED TABLE

[75] Inventor: Andrew A. Gehring, Kewaskum, Wis.

[73] Assignee: Manco Corporation of West Bend, West Bend, Wis.

[21] Appl. No.: 91,402

[22] Filed: Aug. 31, 1987

[51] Int. Cl.[4] ..... A47B 5/00

[52] U.S. Cl. ..... 108/149; 108/42; 248/343

[58] Field of Search ..... 108/42, 145, 149; 248/320, 327, 343; 182/150; 79/98, 520, 106, 38

[56] References Cited

U.S. PATENT DOCUMENTS

| | | | |
|---|---|---|---|
| 2,484,678 | 10/1949 | Blumer | 108/149 X |
| 2,580,980 | 1/1952 | Vrooman | 108/42 |
| 3,142,447 | 7/1964 | Bodian | 248/343 X |
| 3,592,146 | 7/1971 | Loomans | 108/149 |
| 3,602,335 | 8/1971 | Gustetic | 182/150 X |
| 3,964,788 | 6/1976 | Kmetyko | 108/149 X |

*Primary Examiner*—Peter A. Aschenbrenner
*Attorney, Agent, or Firm*—Donald Cayen

[57] ABSTRACT

A table suspended from a room ceiling has a table top that is positionable between a retracted first position against the ceiling and a second position extended from the ceiling toward the floor. Extension and retraction occur through a pivotal arm assembly. The arm assembly is controlled by electric or manual powered drive mechanisms. The drive mechanisms are enclosed in a modular housing that is manufactured to interchangeably accept either the electrical or the manual drive mechanisms. The suspended table includes a table top that is rotatable about a vertical axis.

7 Claims, 6 Drawing Sheets

SUSPENDED TABLE

BACKGROUND OF THE INVENTION

1. Field of the Invention

This invention pertains to furniture, and more particularly to foldable tables.

2. Description of the Prior Art

Various types of furniture have been developed that conserve space in multipurpose rooms of schools, hospitals, nursing homes, and similar institutions. For example, stackable chairs and collapsible tables are well known.

A particularly beneficial type of foldable furniture is the suspended table disclosed in U.S. Pat. No. 3,592,146. That table is suspended from the room ceiling, against which it is retracted when not in use. When the table is retracted, the entire floor in the room is available for productive use. In addition, the necessity of closets or other expensive but passive storage space is eliminated.

The suspended table of the U.S. Pat. No. 3,592,146 patent has enjoyed considerable commercial success. The table is available with manual or electrically powered extension and retraction systems. However, prior manually and electrically driven tables included housings and other components that were designed specifically for one or the other drive system. Consequently, manufacturing and inventory costs were undesirably high. Prior suspended tables were also occasionally handicapped by the lack of flexibility in the angular position of the table tops relative to the rooms in which they were used.

Thus, a need exists for a suspended table that is more versatile to manufacture and operate than was previously available.

SUMMARY OF THE INVENTION

In accordance with the present invention, an adjustable suspended table is provided that includes a modular drive system for actuating table movements. This is accomplished by apparatus that includes a drive housing that is universally adaptable to manual and electrical control.

In both the manual and electric systems, the suspended table is mounted to a room structural ceiling through a sturdy universal structural mounting frame. A recessed mounting frame is hung from the universal structural mounting frame. The recessed mounting frame is adjustable vertically such that a flange thereon may be used to suppot finish ceiling panels.

A table unit assembly is fixed to the recessed mounting frame. The table unit assembly includes a drive housing and various drive mechanisms that actuate and control a foldable arm assembly. The arm assembly is supported by the table unit assembly drive housing. In turn, the arm assembly supports a table base assembly and a table top. The table unit assembly, arm assembly, and table base assembly cooperate to extend the table top from the ceiling toward the room floor and to retract the table top back against the ceiling. In electrically powered models, the drive mechanisms are driven directly by an electric motor. In manual models, the drive mechanisms are driven indirectly through manual positioning of the table top.

The table unit assembly drive housing is comprised of a metal weldment that is suitably constructed to support and protect both the manual and electrical drive mechanisms. The housing includes a four-sided structure having two side walls and two end walls. A pair of spaced cross angles extend between and are joined to the side walls near the lower corners thereof. Supported on the two cross angles are a pair of gear plates. Each gear plate is parallel to and spaced a predetermined distance from one of the side walls. One gear plate and side wall are machined to mount an electric motor with integral speed reducer and the drive mechanism components associated with the electric system. The second gear plate and side wall are machined to accept the drive mechanism components associated with the manual system. To enclose the housing from below, sheet metal covers are fastened to the cross angles and end walls.

Two pairs of coaxial pins are mounted between the housing side walls and associated gear plates. Supported for rotation on the pairs of pins is the arm assembly. The arm assembly includes a pair of inverted generally A-shaped arms. The arms are hinged transversely at approximately their midpoints so as to create upper and lower sections for each arm. The two arms terminate and are joined at the table base assembly. The table base assembly includes a frame that surrounds a pair of meshing gear segments, with one segment being fixed to the end of each arm. The table top is fastened to the underside of the table base frame.

To drive the arm assembly from the table unit assembly, a gear segment is attached to one free end of each inverted A-shaped arm. The segments mesh with the drive mechanism in the table unit assembly. In the electrically powered model, operation of the electric motor and drive mechanism causes the arms to rotate in opposite directions about the coaxial pins. With rotation of the drive mechanism in a first direction, the arms rotate to cause the two sections of each arm to fold against each other about their respective hinges and thereby retract the table top toward the room ceiling. Operating the drive mechanism in the opposite direction causes the two sections of each arm to unfold and extend the table top away from the ceiling and toward the floor. In the manual suspended table, the table top is manually raised or lowered to backdrive the table unit assembly drive mechanism. To counterbalance the weight of the arm assembly, table base assembly, and table top, the table unit assembly includes strong helical safety springs that resist table extension and aid table retraction.

Further in accordance with the present invention, the table top is rotatable on the arm assembly about a vertical axis. To accomplish table top rotation, a carousel assembly is installed on the underside of the table base assembly. The carousel assembly includes a heavy plate with a downwardly extending vertical post. The lower end of the post is threaded to accept a nut. A central hole in the table top is placed over the post, and the table top is supported by a thrust bearing interposed between the table top and post nut. A pin and an arrangement of holes in the table top and in a bearing plate cooperate to locate the table in any of several angular locations.

Other advantages, benefits, and features of the present invention will become apparent to those skilled in the art upon reading the detailed description.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended thereto.

Figure 1:
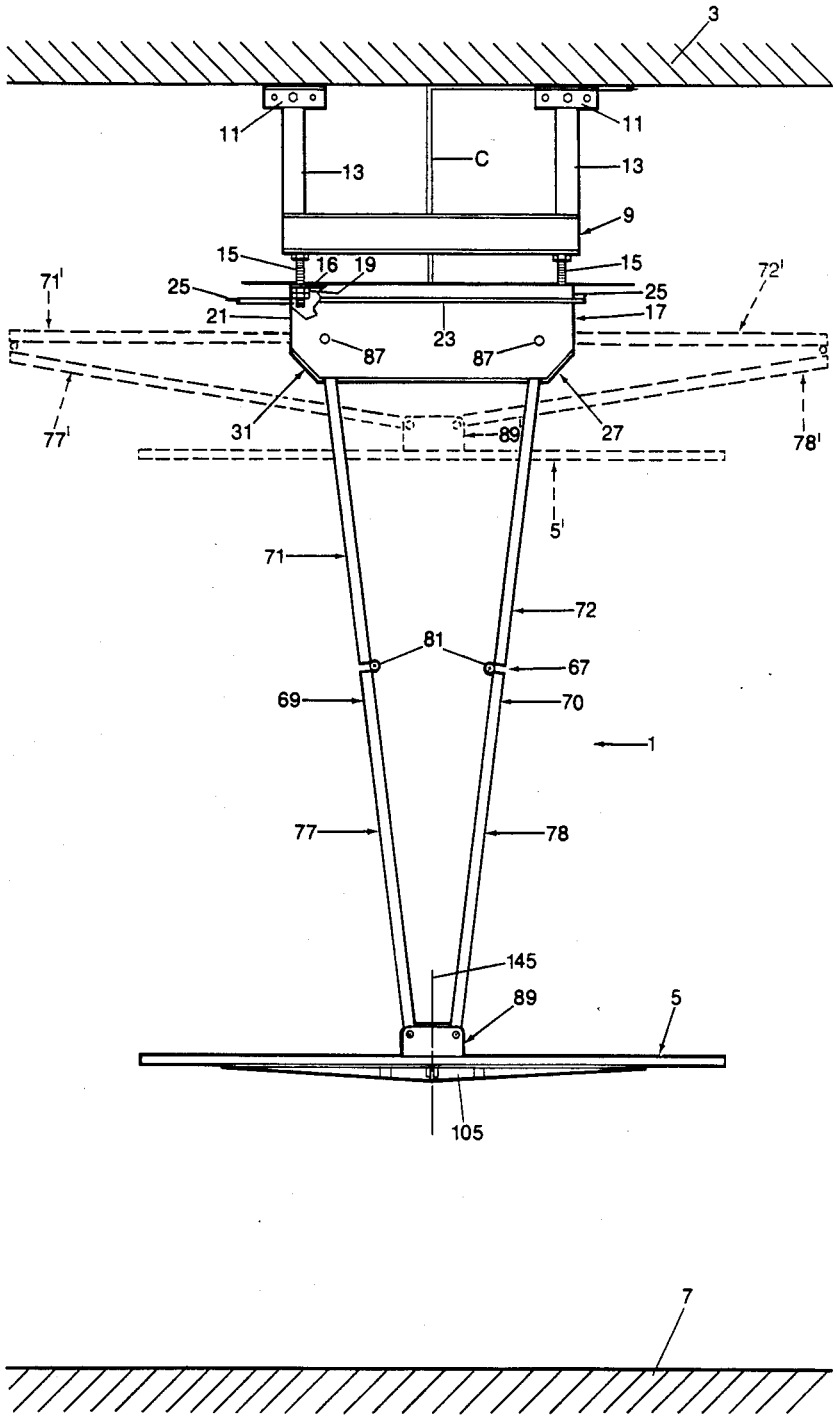
FIG. 1 is a partially broken side view of the suspended table of the present invention.

Referring to FIG. 1, a suspended table 1 is illustrated that includes the present invention. The suspended table eliminates the need for table storage space in or near meeting, recreaction, dining, and other similarly used rooms.

The suspended table 1 is securely mounted to a building structural ceiling 3. The suspended table includes a table top 5 that is moveable between two positions. The first position is represented by the solid lines 5, wherein the table top is extended away from the ceiling 3 and toward the room floor 7. The second position is represented by the dashed lines 5', wherein the table top is retracted against the ceiling.

To securely mount the suspended table 1 to the structural ceiling 3, four angle brackets 11 are fastened to the structural ceiling with expandable anchor bolts, not shown. The upstanding legs 13 of a universal structural mounting frame 9 are secured to the four brackets 11. Also see FIG. 2. Depending from the universal structural mounting frame 9 are four long threaded studs 15 that pass through aligned holes in a horizontal plate 16 of a surface mounting frame 17. Nuts 19 hold the surface mounting frame 17 to the universal structural mounting frame and provide vertical adjustment relative thereto. The recessed mounting frame further includes four vertical walls 21, from the free ends of which extend horizontal flanges 23. The nuts 19 are adjusted on the studs 15 such that the flanges 23 are positioned to support the ends of decorative ceiling panels 25, FIG. 1. Alternately, the flanges 23 may support the ends of transparent or translucent panels used with recessed fluorescent lights, not illustrated in FIG. 1.

To the recessed mounting frame 17 is mounted a table unit assembly 27. Mounting is accomplished by means of the studs 15 passing through appropriate holes 28 in partial top panels 29 and 30 of a table unit assembly drive housing 31. See FIGS. 2, 3, and 5. The panels 29 and 30 rest on nuts 33 threaded onto the studs.

In accordance with the present invention, the table unit assembly drive housing 31 is constructed for the use with both the electrical and manual versions of the suspended table 1. The table unit assembly 27 includes, in addition to the housing 31, the drive mechanism for extending and retracting the table top 5. The drive mechanism may be electrically powered, as shown in FIG. 2, or it may be manually operated, as shown in FIG. 3.

Figure 2:
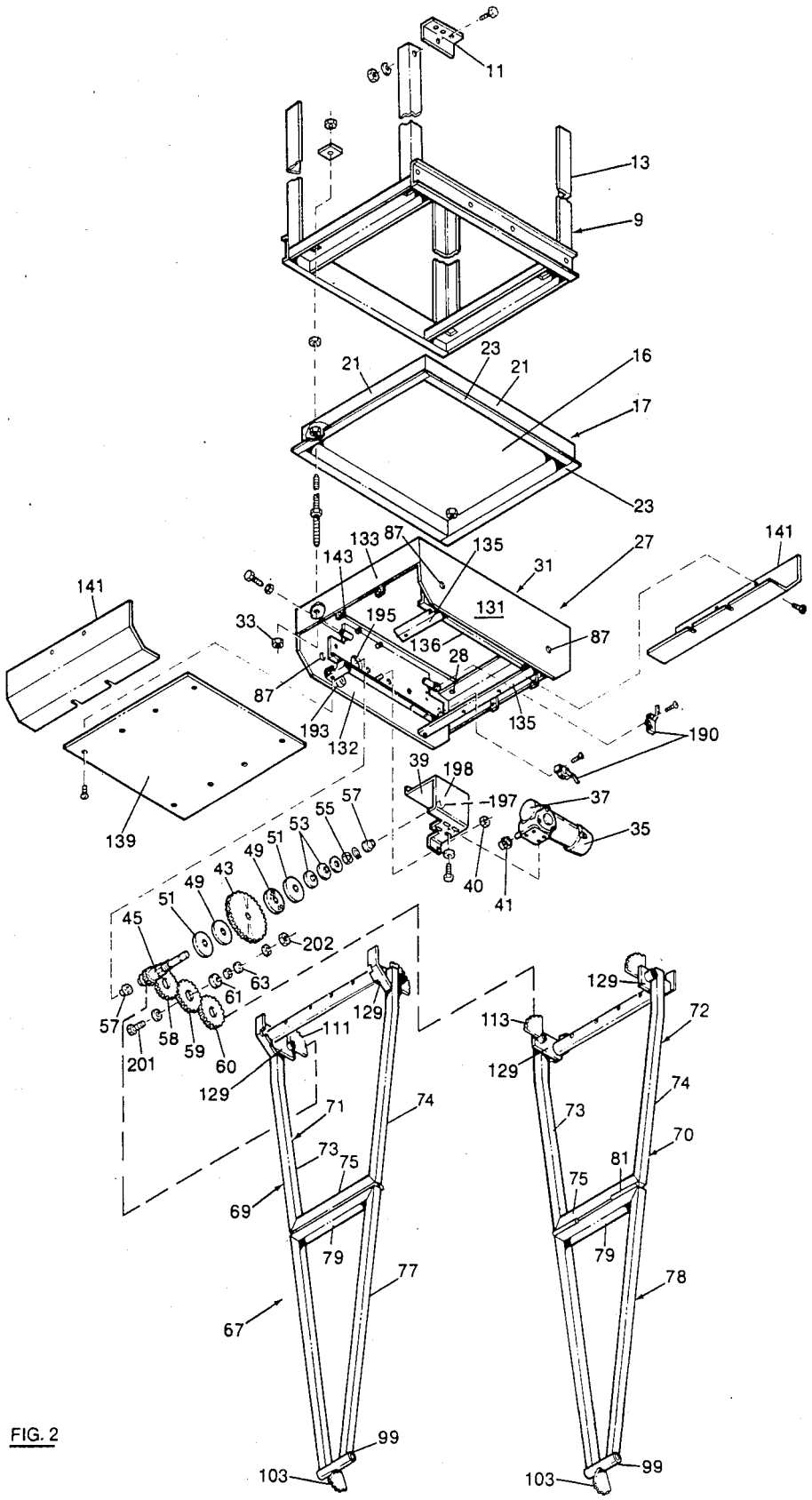
FIG. 2 is an exploded perspective view of the table unit assembly with an electrically powered drive mechanism.

The electrically powered table of FIG. 2 comprises an electric motor 35 with a right angle speed reducer 37. The motor 35 and the speed reducer 37 are mounted to the housing 31 by means of a generally U-shaped bracket 39. Also see FIG. 5. Fasteners 40 pass through holes 42 in the lower wall of the bracket 39 for securing the speed reducer and motor to the bracket 39. A pinion 41 mounted to the output shaft of the speed reducer meshes with a clutch gear 43. The clutch gear 43 is freely rotatable on a pinion shaft 45, but the clutch gear drives the pinion shaft through a safety clutch 47. The safety clutch 47 includes a friction disk 49 and a steel disk 51 on both sides of the clutch gear. At least one steel disk 51 is keyed or splined to the pinion shaft 45. One or more Belleville washers 53 are adjustably pressed against one of the steel disks by nut 55 threaded onto the pinion shaft. The Belleville washers are set to permit the safety clutch to slip and prevent injury and damage if the moving table strikes a person or object. Reference numerals 57 represent bearings for rotatably mounting the pinion shaft in the housing 31 and bracket 39 Meshing with the pinion shaft is a train of three spur gears 58, 59, and 60, each of which is rotatably mounted in the housing 31 by means of conventional bearings 61 and 63.

Figure 3:
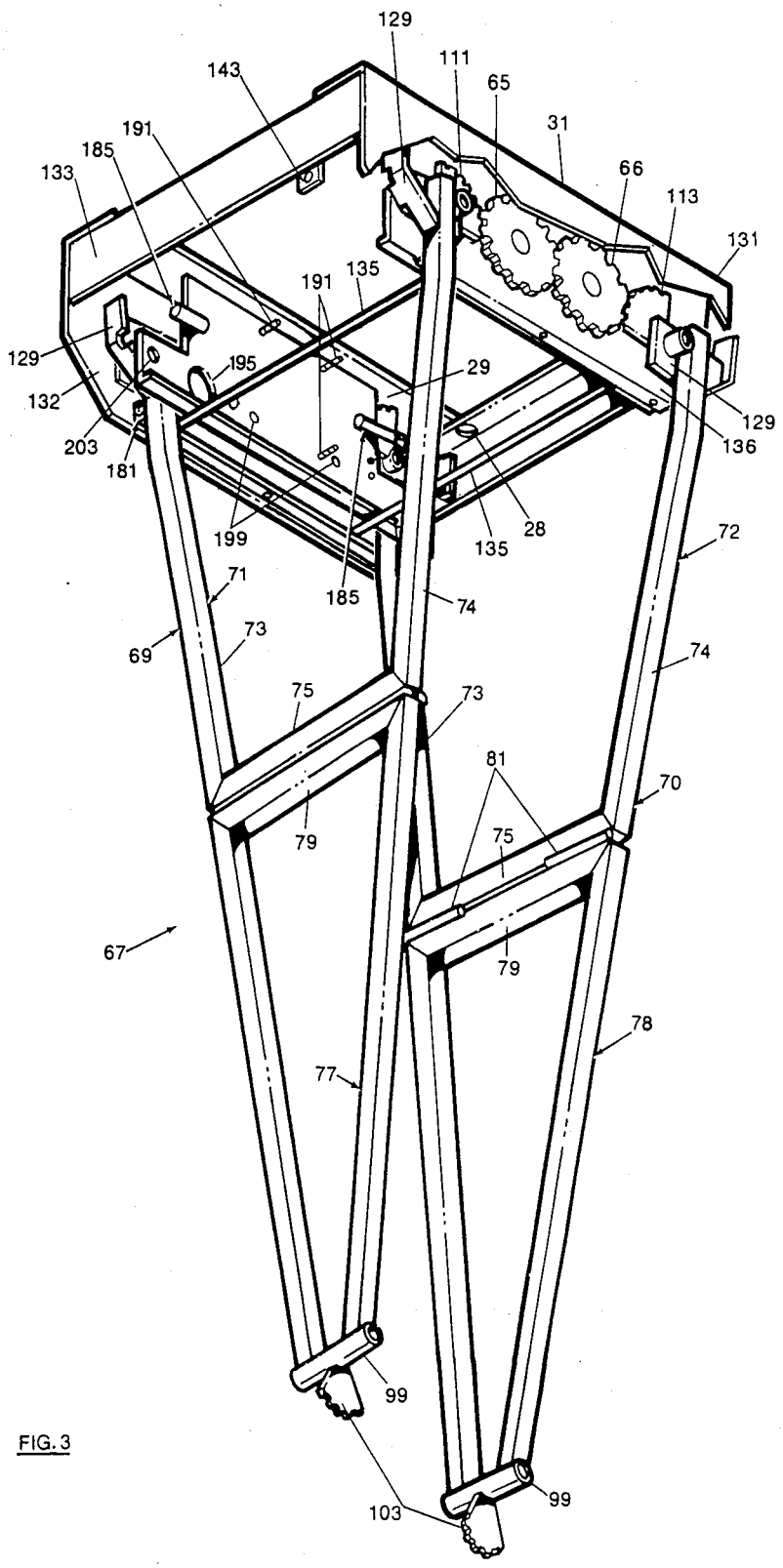
FIG. 3 is a perspective view of the table unit assembly with a manually operated drive mechanism.

Turning to FIG. 3, the drive mechanism of the manually operated version of the suspended table 1 of the present invention will be described. The manual version includes the drive mechanism modular housing 31. In the illustrated construction, the manual drive mechanism further comprises a pair of meshing spur gears 65, 66 that are suitably journaled in the housing by conventional bearings, not shown.

Figure 4:
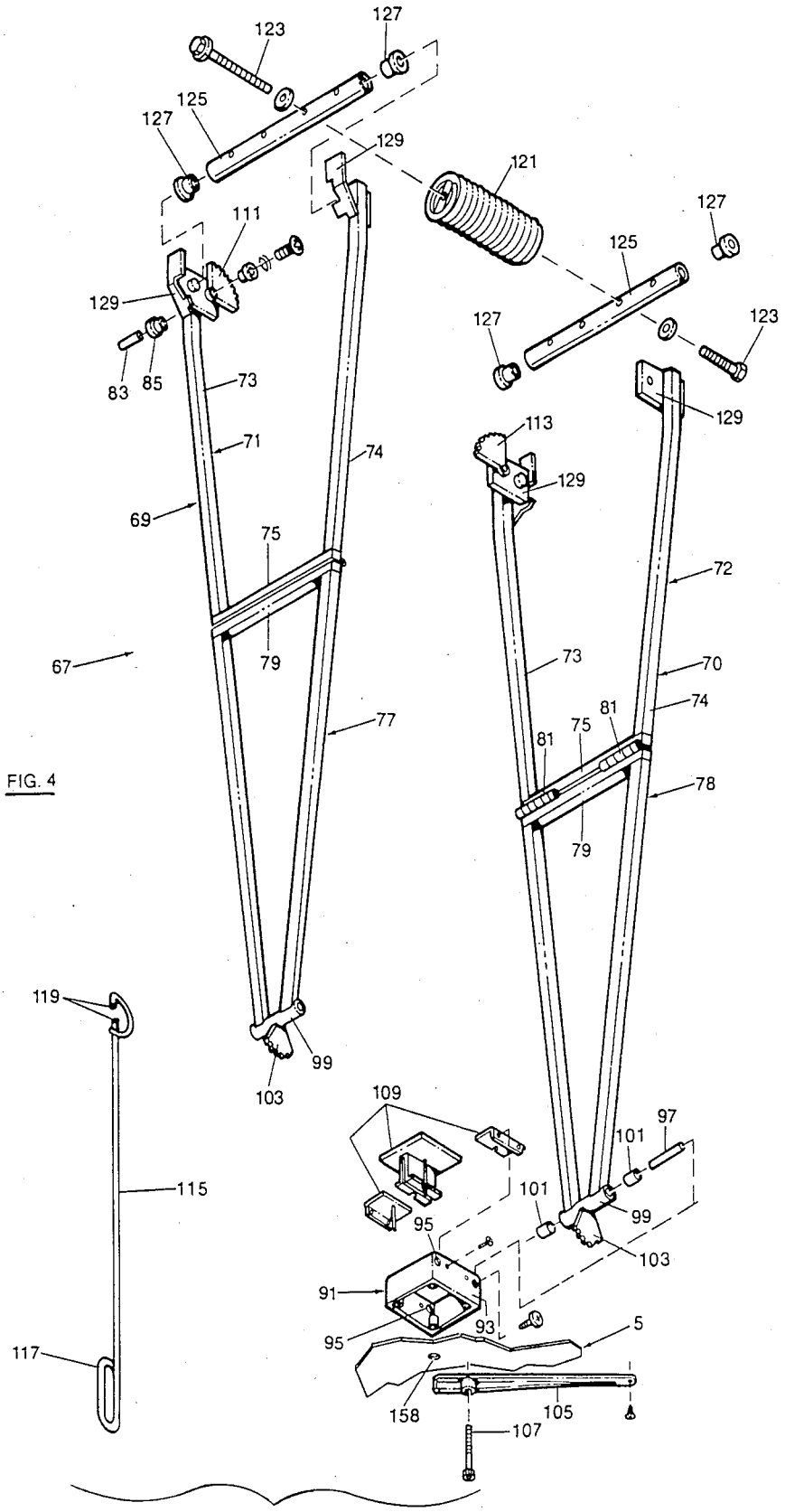
FIG. 4 is an exploded perspective view of the arm assembly of the suspended table of the present invention.

Referring to FIGS. 1 and 4, the table top 5 is extended and retracted relative to the ceiling 3 and housing 31 by an arm assembly 67. The arm assembly 67 comprises a pair of inverted generally A-shaped arms 69 and 70. Each arm 69 and 70 has an upper section 71, 72, respectively. Each arm upper section 71, 72 has legs 73, 74 and a brace 75. Each arm 69, 70 also has a generally triangular shaped lower section 77, 78, respectively, that includes a brace 79. The braces 75 and 79 are pivotally connected together by hinges 81. The legs 73, 74 of the upper sections 71, 72 are pivotally mounted in the housing 31 by pairs of coaxial pins 83, together with bearings 85, that extend through suitable housing bores 87.

To hold the table top 5 to the arm assembly 67, the suspended table 1 includes a table base assembly 89. The table base assembly 89 comprises a four-sided open top frame 91 having two pairs of opposed walls. One pair of opposed walls 93 is manufactured with two pairs of aligned bores 95. The frame 91 is joined to the lower ends of the arm assembly by means of pins 97 that extend through the frame bores 95 and through tubular members 99 welded to the lower end of each lower arm section 77, 78. Bearings 101 ensure minimum friction in the pivotal joints between the pins 97 and tubular members 99.

To prevent the table top 5 and table base assembly 89 from swinging about the pins 83 when the suspended table 1 is in the extended position, each arm assembly tubular member 99 is provided with a gear segment 103. The teeth of two gear segments 103 mesh when the lower ends of the arms 69, 70 are pivotally joined to the frame 91 by the pins 97. To hold the table top to the frame 91, a number of radially entending elongated support brackets 105 are fastened in a horizontal plane to the frame 91 with long screws 107. The table top is sandwiched between the brackets 105 and the frame. A trio of covers 109 are used to close the top of the frame 91.

To pivot the arm assembly 67 about the pins 83 for extending and retracting the table top 5, the free ends of the legs 73 of the arm upper sections 71 and 72 are provided with gear segments 111 and 113, respectively. In the electrically powered version of FIG. 2, the gear segment 111 meshes with the pinion shaft 45. Gear segment 113 meshes with gear 60. In the manual version of FIG. 3, the gear segment 111 meshes with gear 66, and gear segment 113 meshes with gear 65, as will be explained fully hereinafter.

In operation, the electrically powered model of FIG. 2 receives electrical power through conventional conduit C (FIG. 1) to energize appropriate electrical circuitry and the motor 35. Mechanical power from the motor is transmitted through the speed reducer 37 and safety clutch 47 and ultimately to the gear segments 111 and 113. Consequently, the upper arm sections 71 and 72 of the arm assembly 67 rotate in opposite directions. See FIGS. 1 and 4. The two arms 69, 70 swivel at hinges 81 to cause the lower arm sections 77 and 78 to pivot in opposite directions about the hinges. When the motor rotation is in a first direction, the arm assembly folds such that the table base assembly 89 and table top 5 are retracted toward the ceiling 3 as shown in the dashed lines of FIG. 1. Reversing the electric motor causes the arm assembly to unfold and extend the table top from the ceiling toward the floor 7.

In the manually operated table of FIG. 3, a person uses a table hook 115 to extend and retract the suspended table 1. See FIG. 4. The table hook 115 includes a handle 117 at one end and an opposed pair of fingers 119 at the second end. The fingers 119 are spaced apart to accept the thickness of the table top 5 between them.

To counterbalance the weight of the arm assembly 67, table base assembly 89, and table top 5, the suspended table 1 of the present invention includes one or more stiff helical springs 121. Each spring 121 is guided on a long spring bolt 123 that extends between a pair of spring pull bars 125. The ends of the spring pull bars 125 are pivotally journaled by bearings 127 in plates 129 that are welded or otherwise fastened to the free ends of the arm assembly upper arm sections 71, 72. The springs and spring bolts 123 are installed such that the springs are placed in increasing tension as the upper arm sections rotate about the pins 83 to move from the retracted position to the extended position shown in FIGS. 1 and 4. Only minimum tension remains in the springs when the suspended table 1 is in the retracted position. Consequently, the springs assist the electric motor or person to retract the table top, and the springs provide an increasing counterbalancing safety force as the table is extended.

Figure 5:
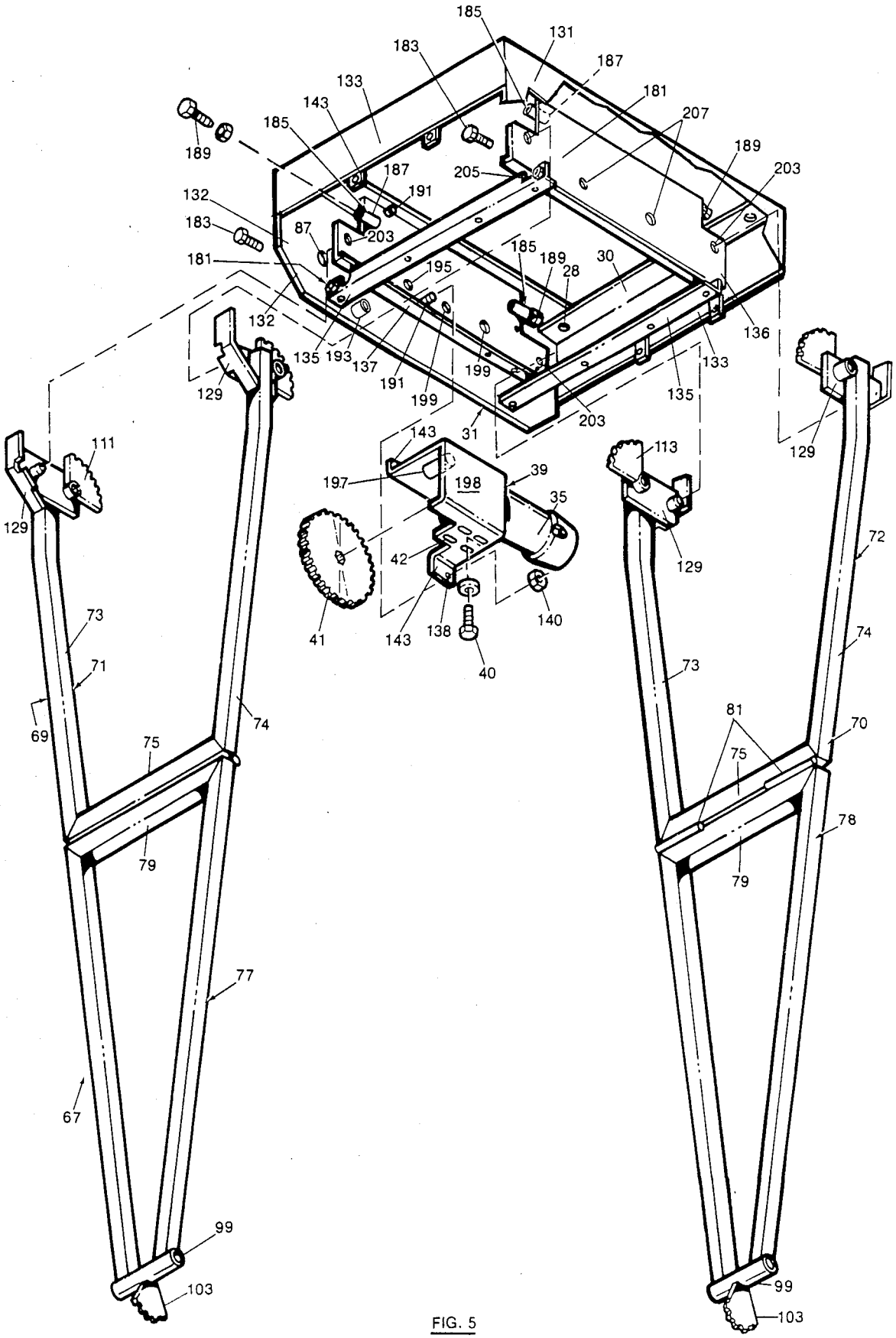
FIG. 5 is an enlarged partially broken exploded perspective view of the table unit assembly housing of the present invention.

It is a feature of the present invention that the housing 31 of the table unit assembly 27 is constructed in a modular fashion suitable for use with both power and manual drive mechanisms. Referring to FIGS. 2, 3, and 5, the housing is preferably fabricated as a weldment having two opposed vertical side walls 131 and 132 that are connected on their respective opposed ends by two vertical end walls 133. Preferably, the side walls 131 and 132 are deeper than the end walls 133. The housing side walls and end walls include partial top panels 29 and 30, respectively. Extending between and attached to the side walls near the lower opposite edges thereof are a pair of horizontal cross angles 135. The cross angles 135 support a pair of gear plates 136, 137, each of which straddles the cross angles. The gear plates 136, 137 are parallel to the side walls, and each is spaced a predetermined distance from an associated wall 131, 132, respectively.

The side wall 132 and gear plate 137 are machined for the electrically powered suspended table 1, FIGS. 2 and 5. The gear plate 137 has three studs 191 welded to it. The studs 191 are located so as to fit within three corresponding mounting holes 138 in outturned flanges 143 in the motor bracket 39, which is held in place on the gear plate studs with nuts 140.

To support one end of the pinion shaft 45, the housing wall 132 has welded to it a short hub 193 that in turn is machined to accept a pinion shaft bearing 57. The pinion shaft passes through a clearance hole 195 in the gear plate 137. The pinion shaft is rotatably mounted on its second end in a hub 197 in the back wall 198 of the motor bracket 39. As mentioned previously, the combination motor 35-speed reducer 37 is mounted to the bracket 39 by screws and washers 40.

The gear plate 137 further includes holes 199 that serve as centers for the gears 59, 60, and 61. Those gears are mounted in the holes 199 by means of the bearings 61 and 63 together with screws 201 and associated nuts and washers 202. The gear plate 137 also defines holes 203 that are coaxial with respective holes 87 in the housing side wall 132. The pairs of coaxial holes 87 and 203 receive the pins 83 for supporting the arm assembly 67, FIG. 4. As mentioned previously, the gear segment 111 on the arm assembly arm 71 meshes with the pinion shaft 45, and the gear segment 113 on the arm 72 meshes with the gear 60.

Referring to FIGS. 3 and 5, the gear plate 136 is machined for the manual drive mechanism. As best seen in FIG. 5, gear plate 136 defines holes 207 that serve as centers for the gears 65 and 66 (FIG. 3). The gear plate 136 also has two holes 203 that are aligned with holes 87 in the housing wall 131 for receiving the pins 83 that support the arm assembly 67 (FIG. 4). For the manual version of suspended table 1, the arm assembly 67 is reversed 180 degrees with respect to FIG. 4, such that gear segment 111 of the arm assembly meshes with gear 66 and gear segment 113 meshes with gear 65. To provide clearance for the segments 111 and 113, both ends of the cross angles 135 are formed with notches 205.

To positively locate the arm assembly 67 in the retracted and extended positions, the suspended table 1 includes two sets of arm stop assemblies. In the construction best illustrated in FIG. 5, the first arm stop assembly 181 is used to precisely locate the suspended table in the extended position. The arm stop assembly 181 comprises four screws 183 with associated locking nuts that are threaded into the cross angles outboard of the notches 205. The screws 183 are set and locked such that each of the four arm assembly legs 73, 74 (FIG. 4) strike a screw head simultaneously. In that manner, the arm stop assembly 181 precisely limits the extended position of the suspended table.

The second arm stop assembly 185 (FIG. 5) controls the location of the arm assembly 67 in the retracted position. The arm stop assembly 185 comprises four arm stop housings 187 that may be in the form of tapped cylinders. Threaded into each cylinder 187 is a cap screw 189. The screws 189 are set and locked with respective lock nuts such that the spring bars 125 (FIG. 4) mounted to the arms 69, 70 strike the screw heads when the arm assembly is in the fully retracted position. Consequently, the arm stop assembly 185 precisely controls the location of the table top 5 in the retracted position.

The electrically powered suspended table 1 includes a variety of electrical components for controlling the motor 35, as, for example, stopping the motor when the table top 5 has reached the extended or retracted position. For stopping purposes, the electrically powered suspended table includes a pair of microswitches 190, FIG. 2. One microswitch 190 is set to open the motor circuit at the instant the arm assembly arm sections 72, 72 (FIG. 4) strike the arm assembly stop 181. The second microswitch is set to open the motor circuit at the instant the spring bars 125 strike the arm stop assembly 185. The microswitches and associated electrical circuitry are of conventional design well known to persons skilled in the art and form no part of the present invention.

To enclose the bottom of the table unit assembly housing 31, aflat cover 139 is fastened to the cross angles 135. See FIGS. 2, 3, and 5. A pair of angled covers 141 are fastened between the flat cover 139 and the end walls 133. For ease of attaching the covers 141 to the housing end walls, small overhanging tapped plates 143 may be welded to the housing side walls.

Figure 6:
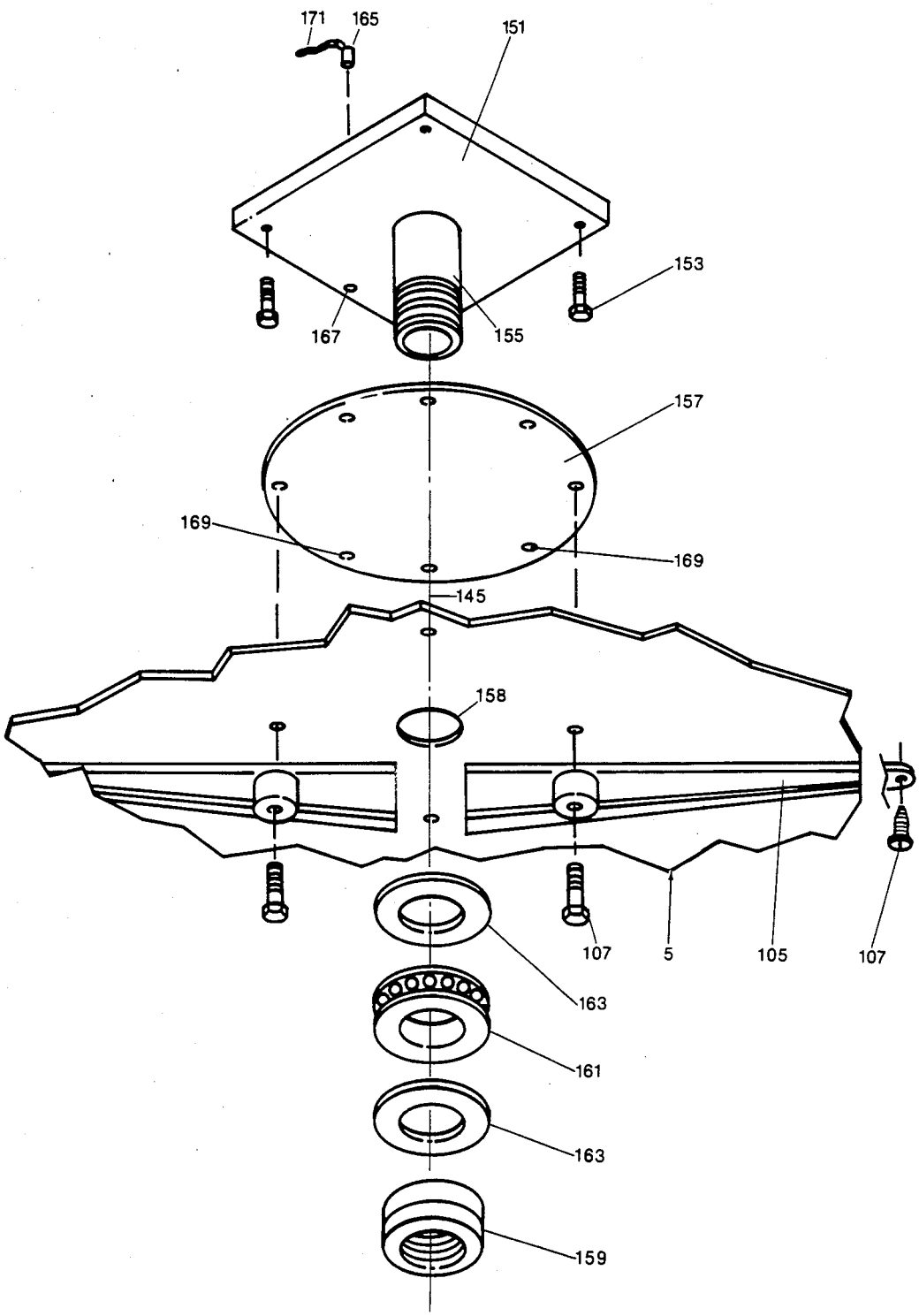
FIG. 6 is an enlarged exploded partial perspective view of a rotatable table top of the suspended table.

Further in accordance with the present invention, the table top 5 may be constructed to rotate about a vertical axis 145 of the suspended table 1. Turning to FIG. 6, reference numeral 151 refers to a heavy plate that is attached to the underside of the table base assembly frame 91 by conventional fasteners 153. Also see FIG. 4. Secured to the underside of the plate 151 is a threaded post 155. Mounted for rotation on the post 155 as a unit are a bearing plate 157, the table top 5 with a hole 158, and the brackets 105, all of which are held together by the screws 107. To support the bearing plate 157, table top, and brackets on the post 155, a nut 159 is threaded and fixed onto the post. To provide smooth friction free rotation to the table top, a thrust bearing 161 and washers 163 are interposed between the underside of the table top and the nut 159. A pin 165 may be used to lock the table top in any of several angular locations by passing through a hole 167 in the plate 151 and one of several alignable holes 169 in the bearing plate 157. To prevent loss, the pin 65 is preferably fastened with a light chain 171 to the frame 91.

Thus, it is apparent that there has been provided, in accordance with the invention, a suspended table that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In combination with a suspended table suspended from a room ceiling including a table top; frame means for mounting the suspended table to the room ceiling; an arm assembly for selectively positioning the table top between a retracted position against the ceiling and an extended position toward the room floor; and a selected one of an electric drive means or a manual drive means for cooperating with the arm assembly to position the table top between the extended and retracted positions, an improved table unit assembly mounted to the frame means and supporting the arm assembly, wherein the improvement comprises a modular housing comprising:

a. a first side wall;

b. a second side wall spaced from and parallel to the first side wall;

c. a pair of end walls fastened to the side walls to form a four-sided enclosure;

d. at least two cross angles extending between and fastened to the first and second side walls;

e. a first gear plate spaced from and parallel to the first side wall, the first gear plate straddling and being supported by the cross angles, the first gear plate and first side wall being adapted and in cooperating relationship to accept the electrical drive means; and f. a second gear plate spaced from and parallel to the second side wall, the second gear plate straddling and being supported by the cross angles and being adapted to accept the manual drive means.

2. The combination of claim 1 further comprising means for rotating the table top about a vertical axis relative to the arm assembly means.

3. The combination of claim 2 wherein the means for rotating the table top comprises:

a. a plate mounted to the arm assembly means;

b. a post depending from the plate;

c. a nut threaded onto the post;

d. bearing means mounted on the post intermediate the plate and the nut for journaling the table top on the post.

4. In combination with a suspended table suspended from a room ceiling including a table top; frame means for mounting the usupended table to the room ceiling; an arm assembly for selectively positionong the table top between a retracted position against the room ceiling and an extended position toward the room floor, an improved table unit assembly for supporting and selectively positioning the arm assembly comprising:

a. a housing mounted to the frame means and having first and second parallel spaced side walls;

b. a first gear plate parallel to the first side wall;

c. a second gear plate parallel to the second side wall;

d. means for supporting the first and second gear plates to the side walls;

e. a generally U-shaped bracket having outturned flanges mounted to the first gear plate, the bracket having a back wall parallel to the first gear plate, the back wall having a hub fastened thereto;

f. a shaft mounted for rotation in the first side wall and in the hub of the U-shaped bracket back wall; and g. electric motor means mounted to the U-shaped bracket and having an output shaft perpendicular to the first gear plate for meshing with the shaft; and h. drive means meshing with the shaft for positioning the arm assembly in response to actuation of the electric motor means.

5. A manually operated suspended table comprising:

a. frame means for mounting to a building ceiling;

b. a housing mounted to the frame means comprising:

i. a four sided enclosure having first and second side walls;

ii. a gear plate spaced from and parallel to the second side wall; and iii. means for supporting the gear plate to the housing side walls;

c. arm assembly means mounted to the housing for pivotal motion relative thereto;

d. a table top supported by the arm assembly means for being manually actuated to pivot the arm assembly means to selectively retract the table top against the building ceiling and to extend the table top away from the ceiling; and e. gear means mounted in the gear plate for controlling the pivotal motion of the arm assembly means in response to manual actuation of the table top.

6. The suspended table of claim 5 wherein:

a. the gear means comprises a pair of meshing gears mounted for rotation in the gear plate; and b. the arm assembly means comprises a pair of gear segments meshing with respective gears to form an intermeshing train for controlling the pivotal motion of the arm assembly means.

7. In combination with a suspended table suspended from a room ceiling including a table top; an arm assembly for selectively positioning the table top between a retracted position against the ceiling and an extended position toward the room floor; and frame means for mounting the suspended table to the building ceiling, a table unit assembly mounted to the frame means and supporting the arm assembly comprising:

a. a housing having first and second spaced parallel walls;

b. a gear plate supported by and positioned between the first and second walls and parallel thereto;

c. first and second gears mounted for rotation in the gear plate and meshing with each other; and d. first and second gear segments attached to the arm assembly and meshing with the respective gears to form an intermeshing train, so that pivoting of the arm assembly is controlled by the first and second gears during positioning of the table top between the retracted and extended positions.

* * * * *